US011832720B2

(12) United States Patent
Gibbons, Jr. et al.

(10) Patent No.: US 11,832,720 B2
(45) **Date of Patent: *Dec. 5, 2023**

(54) CORRUGATED HUTCH

(71) Applicant: Menasha Corporation, Neenah, WI (US)

(72) Inventors: Chris Alan Gibbons, Jr., Bellflower, CA (US); Hector Gonzalez, La Mirada, CA (US)

(73) Assignee: Menasha Corporation, Neenah, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/947,556

(22) Filed: Sep. 19, 2022

(65) Prior Publication Data

US 2023/0071401 A1 Mar. 9, 2023

Related U.S. Application Data

(63) Continuation of application No. 17/197,594, filed on Mar. 10, 2021, now Pat. No. 11,478,076, which is a (Continued)

(51) Int. Cl.

| | |
|---|---|
| ***A47B 43/02*** | (2006.01) |
| ***A47B 47/06*** | (2006.01) |
| ***A47F 5/11*** | (2006.01) |

(52) U.S. Cl.

CPC ..... *A47B 43/02* (2013.01); *A47B 47/06* (2013.01); *A47F 5/116* (2013.01); *A47F 5/11* (2013.01)

(58) Field of Classification Search

CPC .. A47F 5/112; A47F 5/116; A47B 2200/0086; A47B 55/06; A47B 43/00; A47B 47/06; A47B 43/02

USPC ..... 229/120.34, 104, 120.11, 125.28, 149, 229/160; 211/149, 135, 132.1, 153, 186, 211/73, 195, 72; 312/259; 248/174

See application file for complete search history.

(56) References Cited

U.S. PATENT DOCUMENTS

| | | | |
|---|---|---|---|
| 1,827,008 | A | 10/1931 | Huckel |
| 1,912,847 | A | 6/1933 | Earl |

(Continued)

FOREIGN PATENT DOCUMENTS

| | | | |
|---|---|---|---|
| CA | 3076091 | A1 | 9/2020 |
| CA | 3124854 | C | 9/2022 |

(Continued)

OTHER PUBLICATIONS

Leblanc, Rick, "Limits on Export Pallets Creating Corrugated Window of Opportunity; Corrugated Pallet Suppliers Experiencing Renewed Interest for Expert, Domestic Markets," http://www.palletenterprise.com/articledatabase/view.asp?articleID-648; 4 pages; Apr. 1, 2002 Apr. 1, 2002.

(Continued)

*Primary Examiner* — Christopher R Demeree
(74) *Attorney, Agent, or Firm* — GREENSFELDER, HEMKER & GALE, P.C.; Richard C. Himelhoch

(57) ABSTRACT

The present invention provides a hutch having a pair of opposed sidewalls and a back wall and a shelf having a first planar surface extending between the sidewalls supported by four support panels each having a second planar surface transverse to the first planar surface.

16 Claims, 11 Drawing Sheets

Related U.S. Application Data continuation of application No. 16/797,973, filed on Feb. 21, 2020, now Pat. No. 10,973,317, which is a continuation of application No. 15/485,287, filed on Apr. 12, 2017, now Pat. No. 10,568,422.

(60) Provisional application No. 62/323,131, filed on Apr. 15, 2016.

(56) References Cited

U.S. PATENT DOCUMENTS 1,964,880 A 7/1934 Katz
1,992,373 A 2/1935 Johnson
2,018,707 A 10/1935 Daller
D104,437 S 5/1937 Bulman
2,150,743 A 3/1939 Mancuso
2,307,992 A 1/1943 Calhoun et al.
2,339,656 A 1/1944 Shina
D146,386 S 2/1947 Shield
D153,188 S 3/1949 Stensgaard
D158,775 S 5/1950 Malkin
D158,776 S 5/1950 Malkin
2,666,531 A 1/1954 Anderson, Jr.
2,706,066 A 4/1955 Wells
2,743,021 A 4/1956 Glenn
2,798,685 A 7/1957 Mooney
2,884,179 A 4/1959 Rossum
2,918,178 A 12/1959 Leone
2,944,555 A 7/1960 Peel et al.
2,975,890 A 3/1961 Block
2,997,222 A 8/1961 Sperry
3,000,602 A 9/1961 O'Brien
3,026,015 A 3/1962 Severn
3,026,078 A 3/1962 Simkins
3,058,646 A 10/1962 Guyer
3,161,341 A 12/1964 Farquhar
D204,434 S 4/1966 Kingsford
3,362,610 A 1/1968 Van Dyke
3,480,196 A 11/1969 De Simas
3,514,031 A 5/1970 Burgess
3,528,559 A 9/1970 Miller
3,690,118 A 9/1972 Rainwater
3,696,990 A 10/1972 Dewhurst
3,730,417 A 5/1973 Lawson
3,857,494 A 12/1974 Giardini
3,879,053 A 4/1975 Chvala
3,886,348 A 5/1975 Jonathan et al.
3,889,867 A 6/1975 Berg
3,944,128 A 3/1976 Hogan
D239,805 S 5/1976 South
4,004,691 A 1/1977 Wihksne
D244,117 S 4/1977 Naylor
4,085,847 A 4/1978 Jacalone
4,099,813 A 7/1978 Olivan
4,171,741 A 10/1979 Fish
4,271,766 A 6/1981 Schmiedeler
4,283,000 A 8/1981 White
4,292,901 A 10/1981 Cox
4,311,100 A * 1/1982 Gardner ..... A47F 5/116 108/165
4,375,874 A 3/1983 Leotta et al.
4,376,558 A 3/1983 Bandar
4,493,424 A * 1/1985 Smith ..... A47F 5/116 108/165
4,503,973 A 3/1985 Andersson
4,506,790 A * 3/1985 Muscari ..... A47F 5/116 211/59.4
D278,493 S 4/1985 Brescia et al.
4,512,541 A 4/1985 Lietzke
4,570,805 A * 2/1986 Smith ..... A47F 5/116 211/132.1
4,602,735 A 7/1986 Aaron
4,610,355 A 9/1986 Maurer
4,618,115 A 10/1986 Belokin, Jr.
4,630,740 A 12/1986 Belokin, Jr.
4,646,922 A 3/1987 Smith
4,658,984 A 4/1987 Brunner
4,673,092 A 6/1987 Lamson et al.
4,688,716 A 8/1987 Winterling
D292,659 S 11/1987 Svezia et al.
D293,520 S 1/1988 Ovitz, III
4,722,473 A 2/1988 Sandrini et al.
D294,908 S 3/1988 Childress
4,765,492 A 8/1988 Howard et al.
4,785,944 A 11/1988 March
4,793,664 A 12/1988 Jackson
4,826,265 A 5/1989 Hockenberry
4,836,379 A 6/1989 Shaw
4,850,284 A 7/1989 DeGroot et al.
4,852,756 A 8/1989 Holladay
4,863,024 A 9/1989 Booth
4,871,067 A 10/1989 Valenti
4,877,137 A 10/1989 Govang et al.
4,899,929 A 2/1990 Grollman
4,911,084 A 3/1990 Sato et al.
4,911,311 A 3/1990 Nagai
4,936,470 A 6/1990 Prindle
D321,100 S 10/1991 Dorrell
D321,295 S 11/1991 Nuebler
D321,615 S 11/1991 Avine et al.
5,067,418 A 11/1991 Carter
5,119,740 A 6/1992 Carter
5,125,520 A 6/1992 Kawasaki
5,141,105 A 8/1992 Maye
5,176,265 A 1/1993 Bennett
D332,883 S 2/1993 Staude
5,183,166 A 2/1993 Belokin, Jr. et al.
5,190,211 A 3/1993 Stoddard et al.
5,195,440 A 3/1993 Gottlieb
5,213,220 A 5/1993 McBride
5,259,631 A 11/1993 Brande
5,269,219 A 12/1993 Juvik-Woods
5,272,990 A 12/1993 Carter
5,315,936 A 5/1994 Smith
D349,202 S 8/1994 Eliadis et al.
5,335,593 A 8/1994 Stoddard et al.
D351,076 S 10/1994 Eliadis et al.
5,357,875 A 10/1994 Winebarger et al.
5,388,531 A 2/1995 Crews et al.
5,392,902 A 2/1995 Vlastakis
5,413,053 A 5/1995 Vannatta
5,427,019 A 6/1995 Moorman
5,443,168 A 8/1995 Dyment et al.
D362,768 S 10/1995 Lechleiter et al.
5,458,411 A 10/1995 Moss
D363,840 S 11/1995 Weshler
5,465,672 A 11/1995 Boyse et al.
5,465,851 A 11/1995 Smith
5,487,344 A 1/1996 Hutchinson
5,487,345 A 1/1996 Winebarger
D369,035 S 4/1996 Potter
D369,043 S 4/1996 Parker
5,520,120 A 5/1996 Badger
5,528,994 A 6/1996 Iseli
5,540,536 A 7/1996 Hoedl
5,543,205 A 8/1996 Liebel
5,590,606 A 1/1997 Crews et al.
5,603,258 A 2/1997 Besaw
5,622,306 A 4/1997 Grigsby et al.
5,630,518 A 5/1997 Collins
5,669,683 A 9/1997 Moss et al.
5,672,412 A 9/1997 Phares et al.
5,678,492 A 10/1997 Pinkstone et al.
5,685,234 A 11/1997 Grigsby et al.
D388,905 S 1/1998 Wells
5,706,953 A 1/1998 Polvere
5,706,959 A 1/1998 Smith
5,711,423 A 1/1998 Fuller, Jr.
D395,534 S 6/1998 Besaw
5,758,783 A 6/1998 Maglione
5,762,213 A 6/1998 Teneveld, Sr.
5,791,487 A 8/1998 Dixon
5,794,542 A 8/1998 Besaw
5,797,499 A 8/1998 Pinco

(56) References Cited

U.S. PATENT DOCUMENTS

D398,461 S 9/1998 Baluk et al.
D398,462 S 9/1998 Baluk et al.
5,809,903 A 9/1998 Young, Jr.
5,816,172 A 10/1998 Carter
5,826,732 A 10/1998 Ragsdale
5,832,841 A 11/1998 Crews et al.
5,881,652 A 3/1999 Besaw et al.
D412,253 S 7/1999 Brozak, Jr.
5,918,744 A 7/1999 Bringard et al.
5,950,914 A 9/1999 Dunton et al.
5,980,008 A 11/1999 Stoever
5,996,366 A 12/1999 Renard
5,996,510 A 12/1999 Harpman et al.
D419,275 S 1/2000 Carter
D419,744 S 1/2000 Carter
6,012,399 A 1/2000 Carter
6,070,726 A 6/2000 Graham
6,076,475 A 6/2000 Kuhn et al.
D428,738 S 8/2000 Brozak, Jr.
6,098,820 A 8/2000 Smith
6,126,131 A 10/2000 Tietz
6,126,254 A 10/2000 Maglione
6,135,030 A 10/2000 Besaw
D433,782 S 11/2000 Carter
D433,839 S 11/2000 Culbertson
6,145,671 A 11/2000 Riga et al.
6,145,794 A 11/2000 Smith
6,164,215 A 12/2000 Cook et al.
6,189,778 B1 2/2001 Kanter
6,302,283 B1 10/2001 Yeh
D453,057 S 1/2002 Sewell
6,354,229 B1 3/2002 Heidtke
6,357,587 B1 3/2002 Melms, Jr.
6,360,465 B1 3/2002 Simpson
6,378,710 B1 4/2002 Grueneberg
6,394,003 B1 5/2002 Lacy, III
6,394,290 B1 5/2002 Walsh et al.
D461,334 S 8/2002 Johnson et al.
D464,498 S 10/2002 Riga et al.
6,510,982 B2 1/2003 White et al.
6,585,118 B2 7/2003 Kellogg
6,612,247 B1 9/2003 Pistner et al.
6,612,669 B2 9/2003 Grueneberg
6,659,295 B1 12/2003 De Land et al.
6,715,623 B2 4/2004 Broerman
6,729,484 B2 5/2004 Sparkowski
6,752,280 B2 6/2004 Dye
6,758,352 B2 7/2004 Gervasi
6,769,368 B2 8/2004 Underbrink et al.
D495,901 S 9/2004 Bosman
6,814,245 B2 11/2004 Leclerc et al.
6,902,074 B2 6/2005 Albrecht
6,905,021 B2 6/2005 Polumbaum et al.
D509,382 S 9/2005 Raile
6,951,300 B2 10/2005 Caille et al.
6,966,447 B2 11/2005 Hiltke et al.
7,007,615 B2 3/2006 Grueneberg
D521,275 S 5/2006 Dusenberry
7,036,196 B2 5/2006 Salatin et al.
7,066,342 B2 6/2006 Baechle et al.
7,066,380 B2 6/2006 Blake
7,089,872 B2 8/2006 Wintermute et al.
7,111,735 B2 9/2006 Lowry
7,137,517 B2 11/2006 Lowry et al.
D533,734 S 12/2006 Campbell
7,191,906 B1 3/2007 Pinco
7,234,604 B2 6/2007 Eisele
7,252,200 B1 8/2007 Hester
D566,989 S 4/2008 Mason
D576,426 S 9/2008 Yuen-Schat et al.
D578,804 S 10/2008 Norman et al.
7,546,926 B2 6/2009 Stolle et al.
7,546,927 B2 6/2009 Lowry et al.
7,571,820 B2 8/2009 Alexander
D603,189 S 11/2009 Raile
7,650,996 B2 1/2010 Mark
7,677,433 B2 3/2010 Little
7,703,665 B2 4/2010 McGowan
7,703,864 B2 4/2010 Moser
7,717,265 B2 5/2010 Honkawa et al.
7,726,474 B2 6/2010 Berger et al.
7,828,169 B2 11/2010 Robinson et al.
7,882,966 B2 2/2011 Field et al.
7,905,365 B2 3/2011 Virvo
7,992,716 B2 8/2011 Jackson
8,002,171 B2 8/2011 Ryan et al.
8,141,713 B2 3/2012 Farkas et al.
8,157,112 B2 4/2012 Bojie
8,317,039 B2 11/2012 Norman
8,485,370 B2 7/2013 Dewhurst
8,651,297 B2 2/2014 Beaty
8,857,633 B2 10/2014 Dewhurst
8,985,328 B2 3/2015 Slaats
9,045,250 B2 6/2015 Henderson et al.
9,198,508 B1 12/2015 Kufel
9,211,021 B2 12/2015 Smith
9,428,298 B2 8/2016 Bersamin et al.
9,474,389 B2 10/2016 Pfeifer et al.
9,487,321 B2 11/2016 Luke
9,743,783 B1 8/2017 Bersamin
9,844,282 B2 12/2017 Smith
9,907,414 B2 3/2018 Heuer
9,919,829 B2 3/2018 Jolley
9,938,040 B2 4/2018 Buscema
9,969,523 B2 5/2018 Ayerst
9,918,569 B1 8/2018 Abel
10,117,529 B2 11/2018 Abel
10,123,635 B2 11/2018 Lilja
10,159,362 B2 12/2018 Smith
10,306,999 B2 6/2019 Smith
10,315,798 B2 6/2019 Pfeifer et al.
10,448,758 B1 10/2019 Abel
10,463,176 B1 11/2019 Sells
10,470,591 B1 11/2019 Heiden et al.
10,524,589 B2 1/2020 Donegan
10,531,750 B1 1/2020 Heiden et al.
10,568,422 B2 2/2020 Gibbons, Jr. et al.
10,568,439 B2 2/2020 Bersamin
10,888,180 B2 1/2021 Robinson
10,905,260 B2 2/2021 Hara et al.
11,154,145 B1 10/2021 Pfeifer
11,457,751 B2 10/2022 Nguyen et al.
11,478,076 B2 10/2022 Gibbons, Jr. et al.
11,517,129 B2 12/2022 Pfeifer
2002/0189507 A1 12/2002 Benner
2003/0042828 A1 3/2003 Bonin
2003/0042829 A1 3/2003 Bonin
2003/0111383 A1 6/2003 Qiu et al.
2004/0195195 A1 10/2004 Mason
2005/0252872 A1 11/2005 Eisele
2005/0274684 A1 12/2005 Swanson
2006/0006096 A1 1/2006 Funk
2006/0261025 A1 11/2006 Heyderman et al.
2006/0283775 A1 12/2006 Mark
2007/0193479 A1 8/2007 Slaats
2007/0272639 A1 11/2007 Alexander
2008/0169339 A1 7/2008 Moser
2008/0169340 A1 7/2008 Sheffer
2008/0173602 A1 7/2008 Field et al.
2008/0265726 A1 10/2008 Sheffer
2009/0107940 A1 4/2009 Norman et al.
2009/0127150 A1 5/2009 Meers
2010/0006529 A1 1/2010 Groff et al.
2010/0025344 A1 2/2010 Virvo
2010/0133215 A1 6/2010 Norman
2011/0000955 A1 1/2011 Manteufel et al.
2011/0049072 A1* 3/2011 Dewhurst ..... A47F 5/116 211/153
2011/0266177 A1 11/2011 Lowry et al.
2012/0074037 A1 3/2012 Orischak et al.
2012/0305512 A1 12/2012 L'Hotel
2013/0097903 A1 4/2013 Gerstner
2013/0213915 A1 8/2013 Pfeifer et al.
2013/0264923 A1 10/2013 Brady

(56) References Cited

U.S. PATENT DOCUMENTS

| | | | |
|---|---|---|---|
| 2013/0277324 | A1 | 10/2013 | Dewhurst |
| 2014/0217047 | A1 | 8/2014 | Frost |
| 2015/0041420 | A1 | 2/2015 | Zelek et al. |
| 2015/0136720 | A1 | 5/2015 | Miller |
| 2016/0066711 | A1 | 3/2016 | Mestres Armengol et al. |
| 2016/0198870 | A1 | 7/2016 | Volz et al. |
| 2017/0079449 | A1 | 3/2017 | Smith |
| 2017/0086604 | A1 | 3/2017 | Goldsmith et al. |
| 2017/0295927 | A1 | 10/2017 | Gibbons, Jr. et al. |
| 2018/0042405 | A1 | 2/2018 | Lilja |
| 2018/0070747 | A1 | 3/2018 | Smith |
| 2018/0092461 | A1 | 4/2018 | Brady et al. |
| 2018/0130382 | A1 | 5/2018 | Hinch et al. |
| 2018/0146803 | A1 | 5/2018 | Urban |
| 2018/0160825 | A1 | 6/2018 | Abel |
| 2018/0289178 | A1 | 10/2018 | McMillan-Sweat et al. |
| 2019/0008290 | A1 | 1/2019 | Ertl |
| 2019/0014927 | A1 | 1/2019 | Nixon et al. |
| 2019/0069694 | A1 | 3/2019 | Smith |
| 2019/0150611 | A1 | 5/2019 | Burnett |
| 2019/0380513 | A1 | 12/2019 | Frost |
| 2020/0037787 | A1 | 2/2020 | Pratsch |
| 2020/0077816 | A1 | 3/2020 | Doane |
| 2020/0113355 | A1 | 4/2020 | Hara et al. |
| 2020/0221866 | A1 | 7/2020 | Dell |
| 2020/0297132 | A1 | 9/2020 | Nguyen et al. |
| 2020/0375375 | A1 | 12/2020 | Robinson |
| 2021/0015273 | A1 | 1/2021 | Nelson |
| 2021/0244178 | A1 | 8/2021 | Gibbons, Jr. et al. |
| 2022/0031092 | A1 | 2/2022 | Pfeifer |
| 2023/0028036 | A1 | 1/2023 | Nguyen et al. |

FOREIGN PATENT DOCUMENTS

| | | | |
|---|---|---|---|
| DE | 102006043829 | A1 | 3/2008 |
| DE | 102011116238 | A1 | 4/2013 |
| EP | 0629557 | A1 | 12/1994 |
| FR | 2984705 | A3 | 6/2013 |
| JP | 6278746 | A | 10/1994 |
| WO | 2008127499 | A1 | 10/2008 |

OTHER PUBLICATIONS

"Solid Wood Packing Materials to Argentina," http://www.corrugatedprices.com/pallets/swang.html; 2 pages, Feb. 6, 2002. Note: Applicant was unable to locate a copy of this reference; however, it believes that a copy is available to the Examiner in the application file for U.S. Appl. No. 12/621,221 at the U.S. Patent and Trademark Office. Feb. 5, 2002.

* cited by examiner

CORRUGATED HUTCH

CROSS-REFERENCE TO RELATED APPLICATIONS

The present invention is a continuation of U.S. patent Ser. No. 17/197,594 filed Mar. 10, 2021, which is a continuation of U.S. patent application Ser. No. 16/797,973 filed Feb. 21, 2020, now U.S. Pat. No. 10,973,317, which is a continuation of U.S. patent application Ser. No. 15/485,287 filed Apr. 12, 2017, now U.S. Pat. No. 10,568,422, which claims priority to and the benefit of U.S. Provisional Application No. 62/323,131 filed Apr. 15, 2016, the contents of which are incorporated herein by reference and made a part thereof.

FEDERALLY SPONSORED RESEARCH OR DEVELOPMENT

N/A

FIELD OF THE INVENTION

Point of sale shelving erected from a corrugated paperboard blank or blanks for supporting and displaying heavy items is disclosed herein.

BACKGROUND OF THE INVENTION

A variety of display units are available for displaying products or other items. However, most display units are expensive to ship and construct. Some paperboard displays are known. However, such displays are only designed to support chips and other light products. The present invention provides a hutch with a plurality of shelves that overcomes the problems of prior units.

SUMMARY OF THE INVENTION

The present invention provides a corrugated paperboard hutch configured to display heavy products. The hutch includes shelves having one or more support structures.

The present invention also provides a hutch having a pair of opposed sidewalls and a back wall and a shelf having a first planar surface extending between the sidewalls supported by four support panels each having a second planar surface transverse to the first planar surface.

The present invention also provides a hutch of a corrugated paperboard material having a pair of opposed sidewalls and a back wall extending between the opposed sidewalls and connected to a portion of each. The hutch has a first support panel extending between the pair opposed sidewalls and having opposed ends, one of each attached to one of each of the opposed sidewalls. The first support panel has a top edge and a bottom edge, a first flap extending transversely from the top edge toward the back wall and a second flap extending transversely from the bottom edge toward the back wall and parallel to the first flap and defining a gap therebetween. The hutch also has a second support panel extending between the opposed sidewalls and in the gap.

In accordance with one aspect of the invention, a hutch of a corrugated paperboard material having a pair of opposed sidewalls and a back wall extending between the opposed sidewalls and connected to a portion of each is provided. The hutch further has a first support panel extending between the pair opposed sidewalls and having opposed ends, one of each attached to one of each of the opposed sidewalls. A first flap extends transversely from the first support panel toward the back wall, and a rectangular prism extends between the opposed sidewalls and has a first planar surface in surface contact with a bottom surface of the first flap to define a shelf.

In accordance with yet another aspect of the invention, a hutch of a corrugated paperboard material having a pair of opposed sidewalls spaced from one another and each having a front edge and a rear edge is provided. A back wall extends between and connects a portion of the rear edge of each of the pair of opposed sidewalls and has a portion removed to form a slot. The hutch also has a shelf extending between the opposed sidewalls with a first panel connecting a portion of the front edges of the pair of opposed sidewalls and having: (1) a vertical surface having a top edge and a bottom edge; (2) a segmented second panel having a first portion extending vertically downwardly from the top portion and a second portion extending horizontally from the first portion toward the back wall, and a tab connected to the second portion along a hinge; and (3) a segmented third panel having a first leg extending horizontally and a second leg extending from a distal end of the first leg and a portion of the second leg extending through the slot and having a vertically disposed surface in contact with an outer planar surface of the back wall, and a slot on the first leg retaining the tab.

Further aspects of the invention are described herein and shown in the Figures.

BRIEF DESCRIPTION OF THE DRAWINGS

To understand the present invention, it will now be described by way of example, with reference to the accompanying drawings in which.

DETAILED DESCRIPTION

Figure 1:
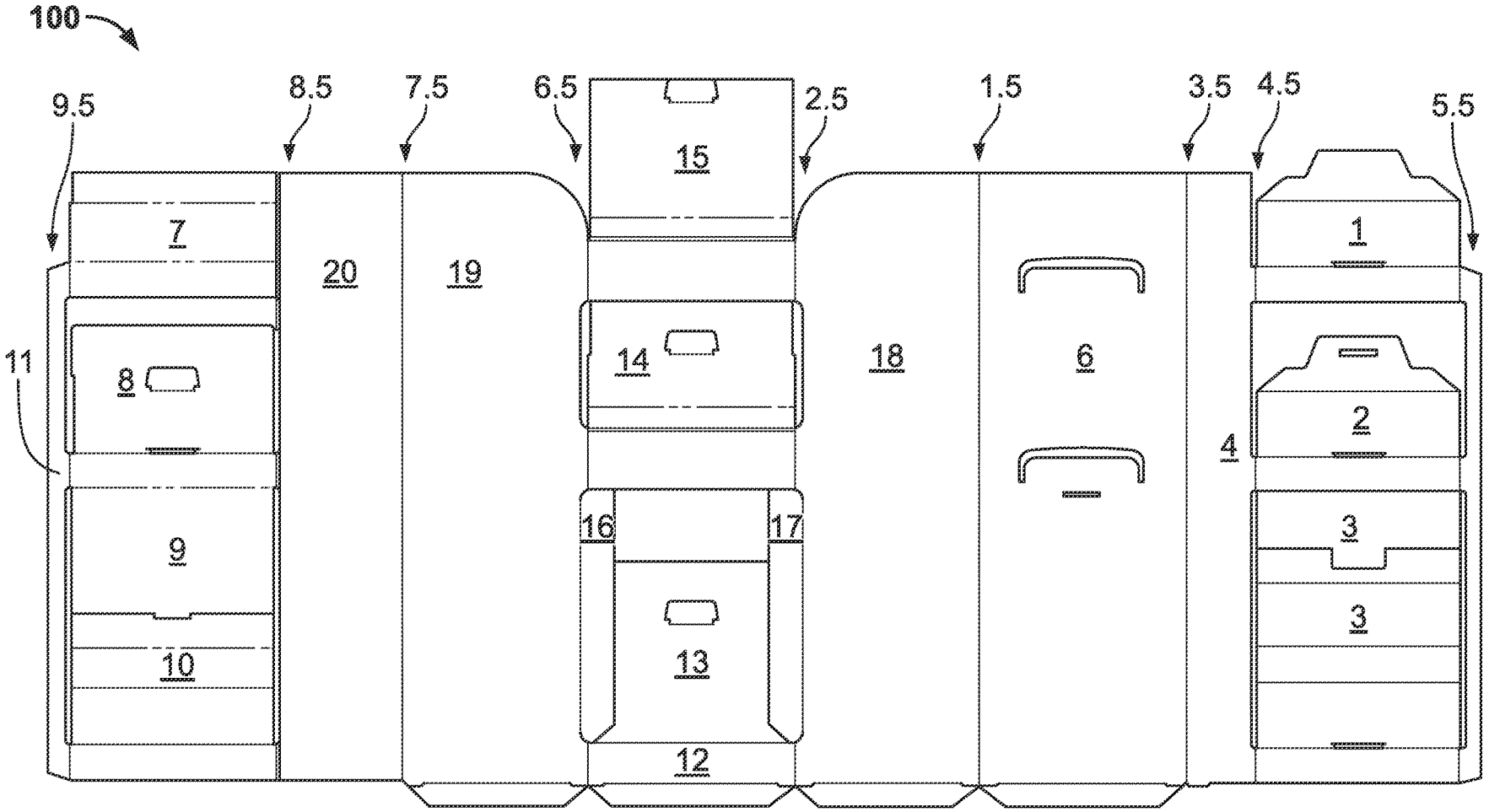
FIG. 1 shows a plan view of a blank of paperboard material for forming a hutch and indicating the vertical fold lines.

While this invention is susceptible of embodiments in many different forms, there is shown in the drawings and attachments, and will be described herein in detail, specific embodiments thereof with the understanding that the present disclosure is to be considered as an exemplification of the principles of the invention and is not intended to limit the invention to the specific embodiments illustrated.

Figure 7:
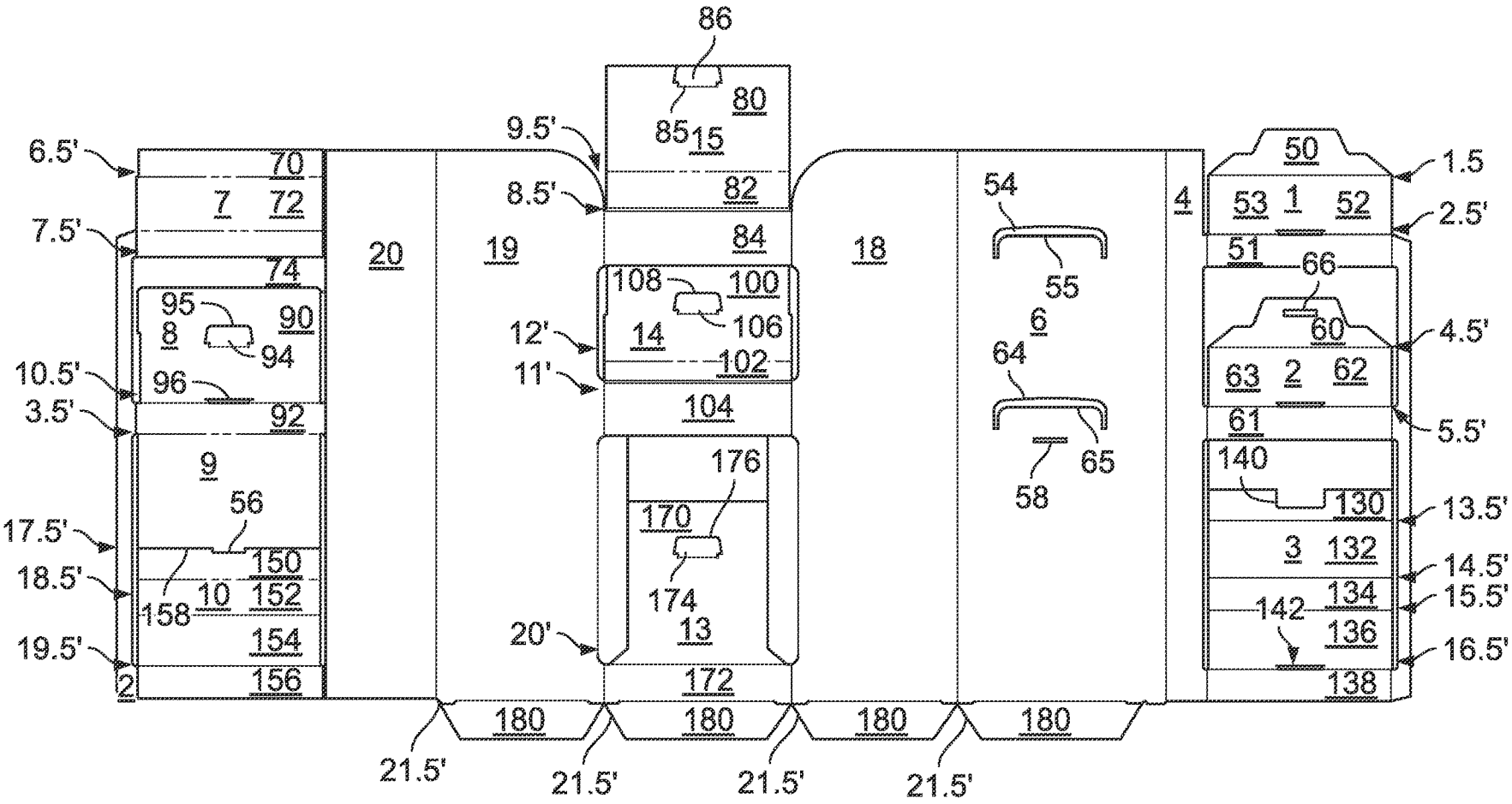
FIG. 7 shows a plan view of a blank of paperboard material for forming a hutch and indicating the horizontal fold lines.
Figure 8:
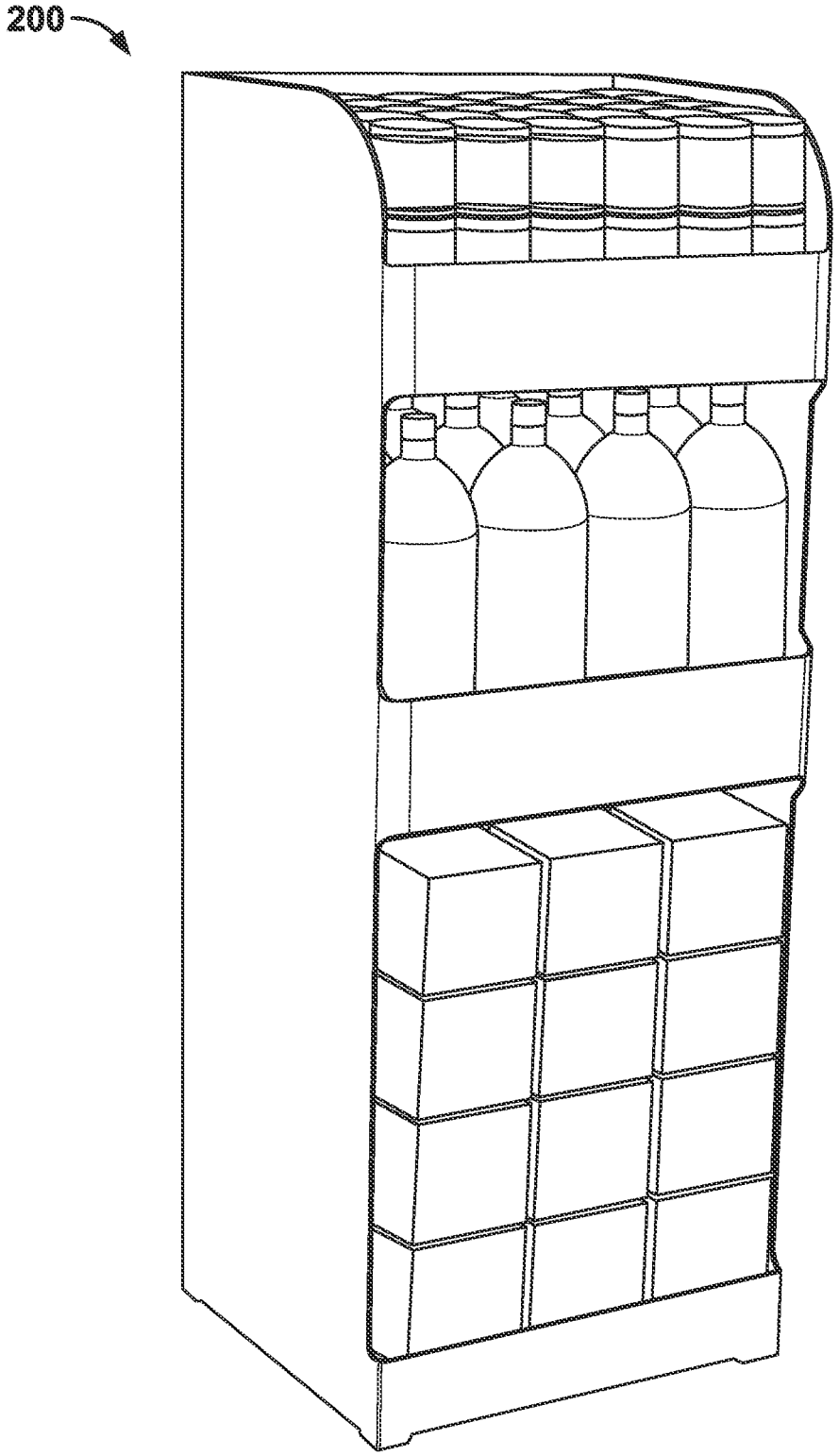
FIG. 8 is a photograph of a hutch displaying products on three shelves.
Figure 14:
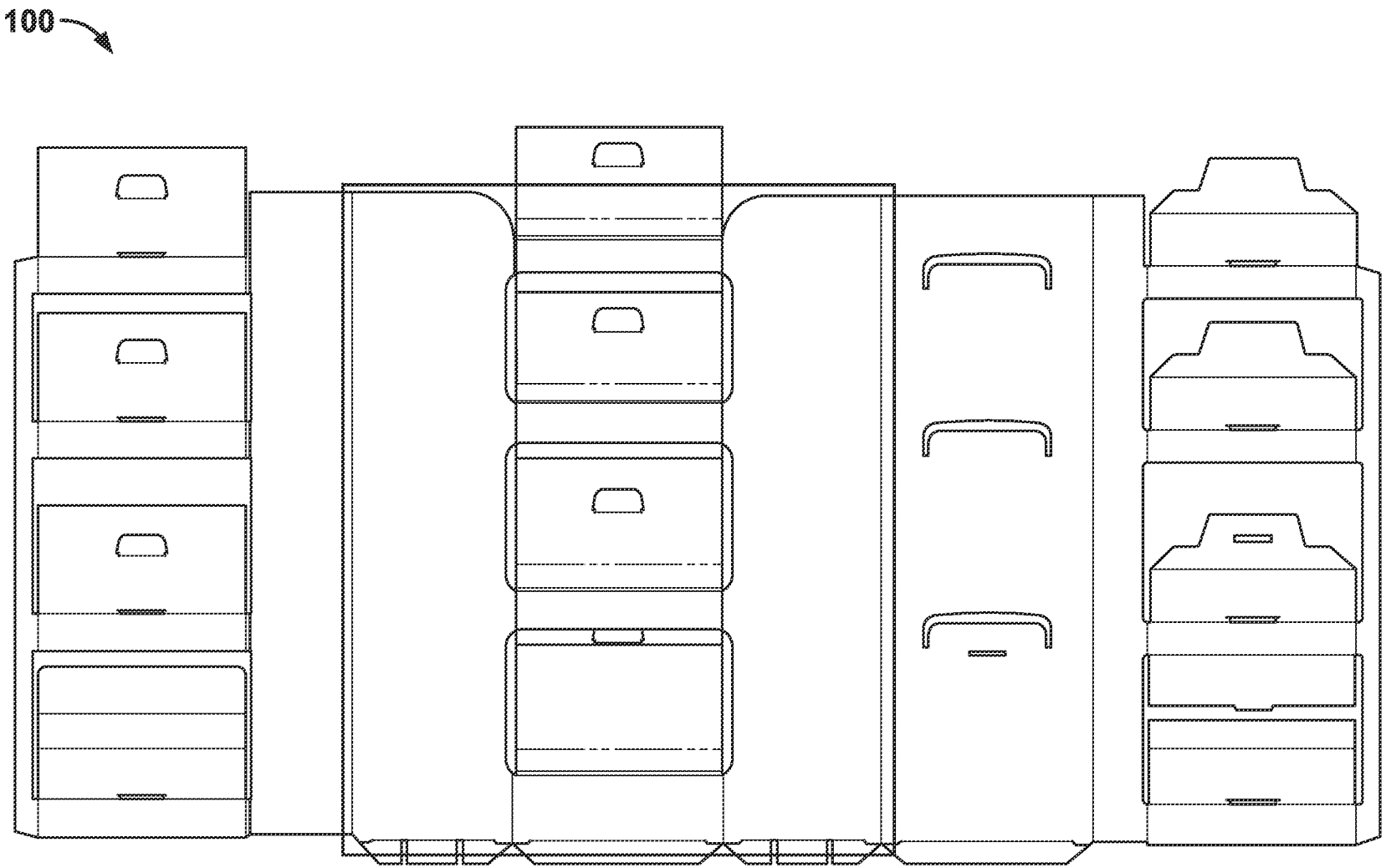
FIG. 14 shows a plan view of a blank of paperboard material for forming a hutch having four shelves.
Figure 15:
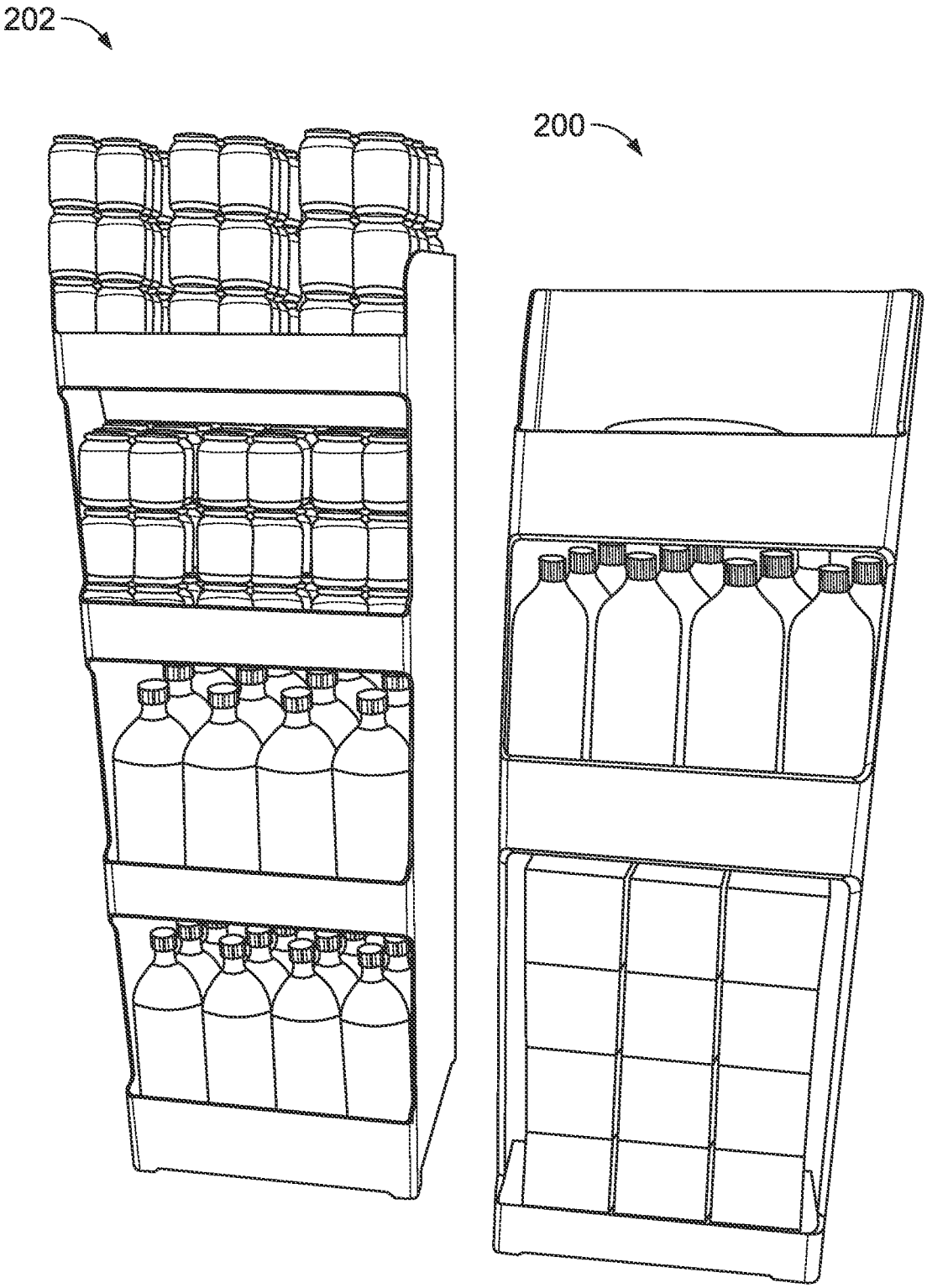
FIG. 15 is a photograph of two hutches, one having four shelves displaying soft drink products and another having three shelves.

FIGS. 1 and 7 show a paperboard blank 100 having a plurality of panels divided along vertical fold lines (FIG. 1) and horizontal fold lines (FIG. 7). When properly folded the blank forms a hutch 200 (FIG. 8) having three shelves for supporting relatively heavy items. FIG. 14 shows a blank when properly folded forms a hutch 202 having four shelves. FIG. 8 shows a hutch 200 having three shelves and FIG. 15 shows a hutch 202 having four shelves and a hutch 200 having three shelves. Notwithstanding the number of shelves, the hutch will be referred to hereafter as hutch 200. The hutch 200 is suitable as a point of sales display for items like bottles of soft drinks and cases of cans of liquids as is shown in FIG. 8. In a preferred form of the invention, a single blank 100, even more preferably a single blank 100 having a continuous planar surface, will be used to form the hutch 200. It is contemplated, however, that two or more blanks could be used to form the hutch without departing from the present invention.

In one preferred form of the invention, the blank 100 is first folded along the vertical fold lines shown in FIG. 1 to form the structures shown in FIGS. 2-6, and then the blank 100 is folded along the horizontal fold lines shown in FIGS. 7, 10-12. While the folding is described in a certain order it should be understood that what is described is an exemplary method and the folding could proceed in a different order to form the hutch 200 shown in FIGS. 8 and 15. Additionally, directional or positional words, such as top, upper, vertical, left/right, etc., are used with respect to the blank 100 and hutch 200 as shown in the various figures and are not meant to limit the invention.

Figure 2:
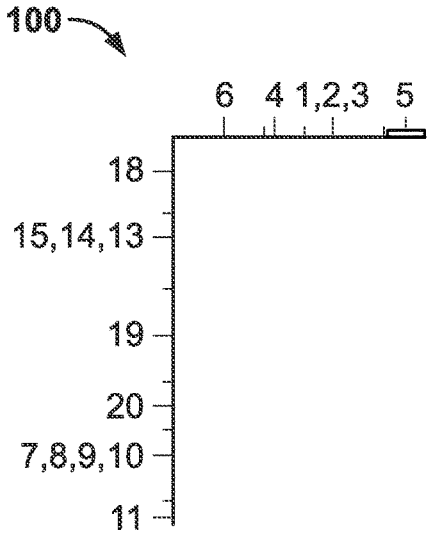
FIGS. 2-6 show a top plan view of the paperboard blank when folding along vertical fold lines.
Figure 3:
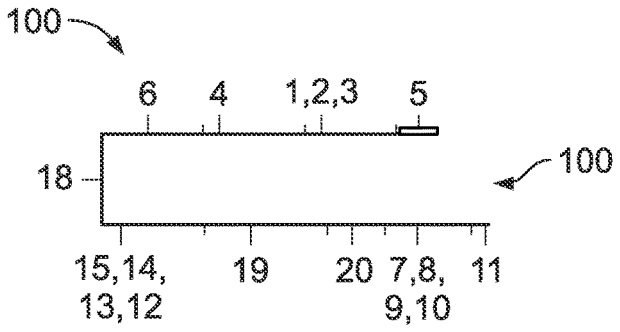
Figure 4:
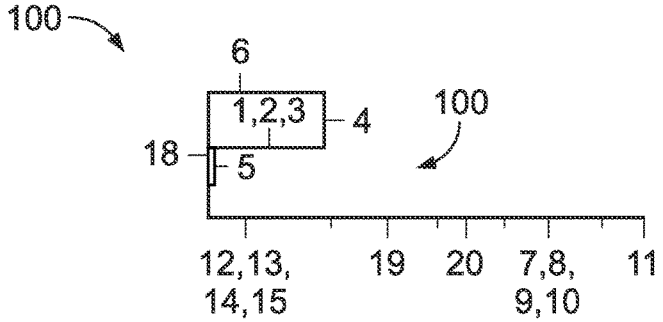

Starting with the folding along vertical fold lines, a panel 18 and those panels to the left are folded along line 1.5, 90° to form a generally L-shaped blank shown in FIG. 2. The L-shaped blank is then folded along line 2.5, 90° to the right placing panels 12, 13 and 14 in registration with panel 6 to form a generally U-shaped blank defining a chamber 100 therebetween (FIG. 3). Then, panel 4 and the panels to its right are folded 90° along line 3.5; panels 1, 2, 3 are folded 90° along line 4.5; panel 5 is reverse folded 90° along line 5.5, and panel 5 is attached to an inner surface of panel 18. In one preferred form of the invention, panel 5 is attached to panel 18 with glue, for example.

Figure 5:
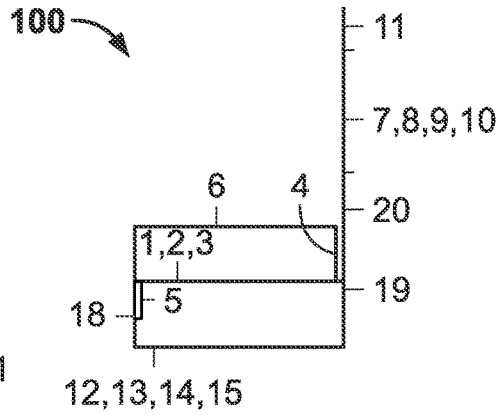
Figure 6:
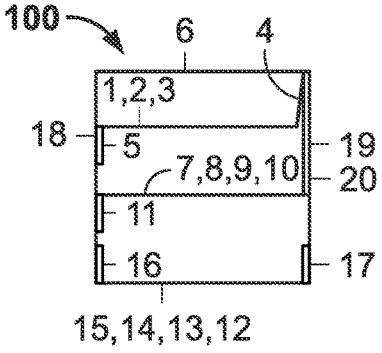

Panel 19 and the panels to its left are folded 90° along line 6.5 toward panel 6 as shown in FIG. 5. Panel 20 and those to the left are folded 180° along line 7.5 placing panel 20 into face-to-face contact with an outer surface of panel 4 and panels 7-10 are folded 90° along line 8.5 to extend parallel to panels 1, 2, 3. Panel 20 is attached to an outer surface of panel 4 with glue, for example. Panel 11 is reverse folded 90° along line 9.5 and attached to an inner surface of panel 18 as shown in FIG. 6. Panels 16 and 17 are respectively folded 180°, in opposite directions, along lines 10.5 and 11.5 into face-to-face contact with an inner surface of panels 19 and 18 and attached thereto with glue, for example.

Figure 10:
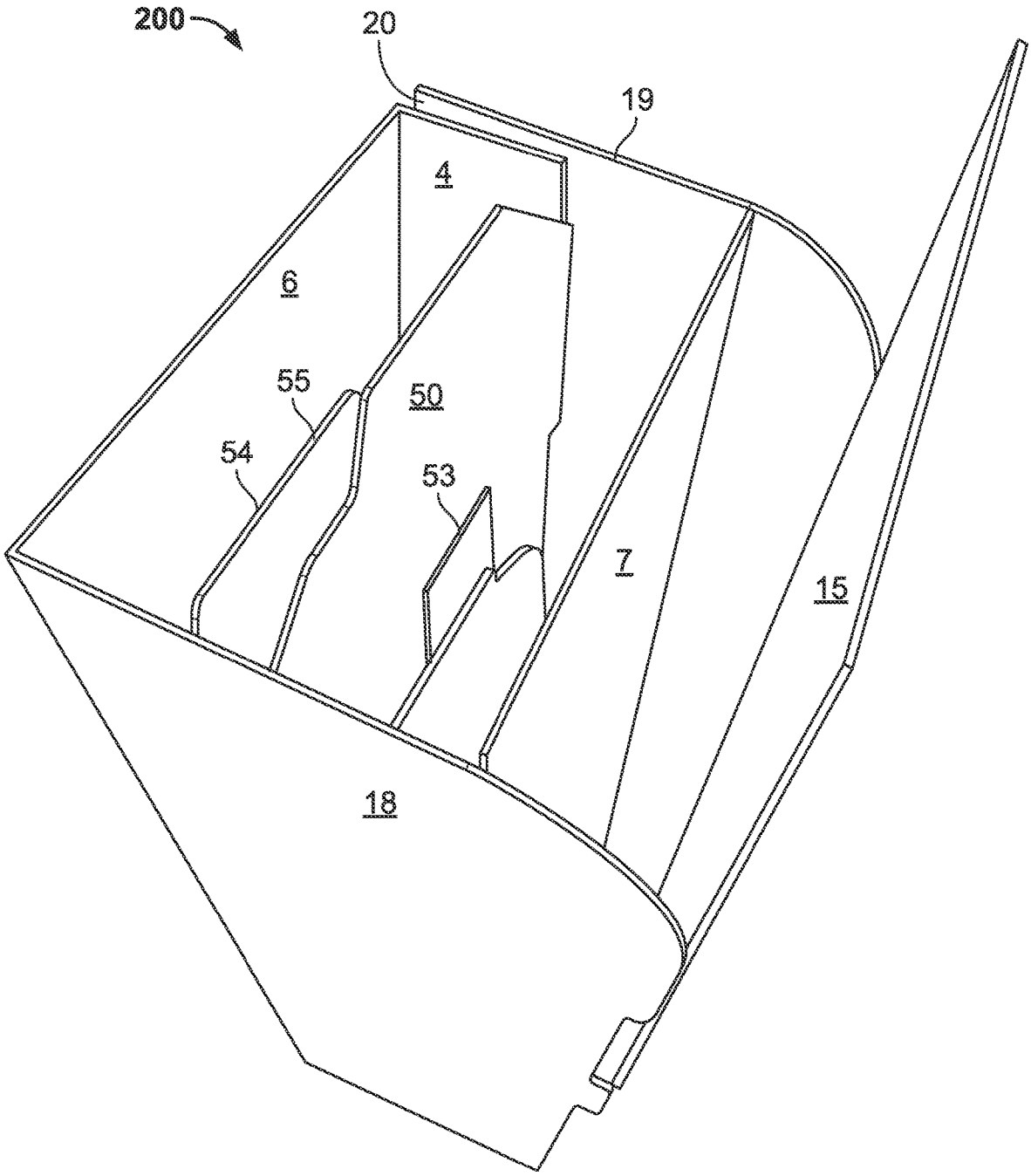
FIG. 10 is a photograph of a top or first shelf before folding along horizontal fold lines.
Figure 11:
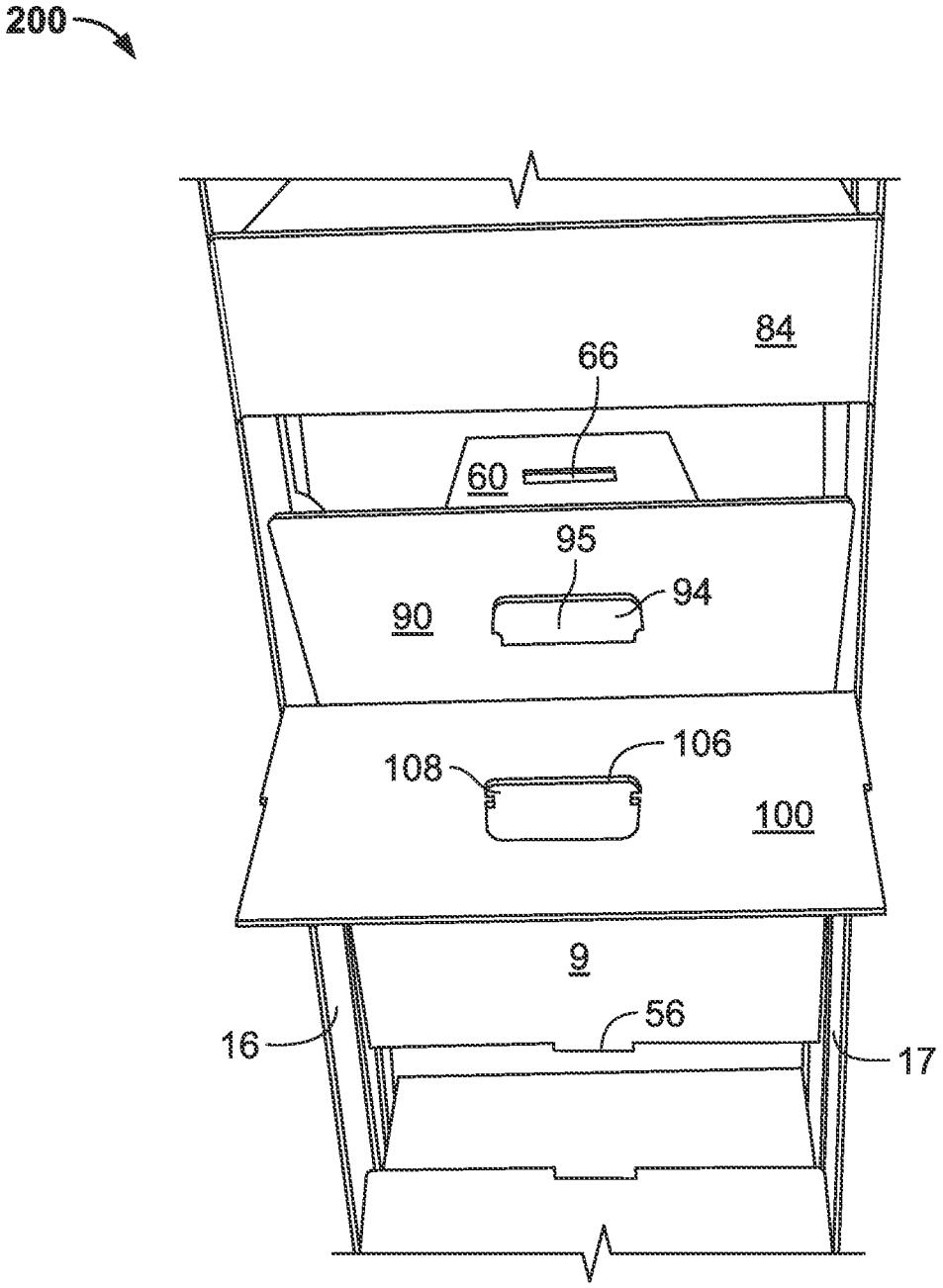
FIG. 11 is a photograph of a front view of a second shelf before folding along horizontal fold lines.
Figure 12:
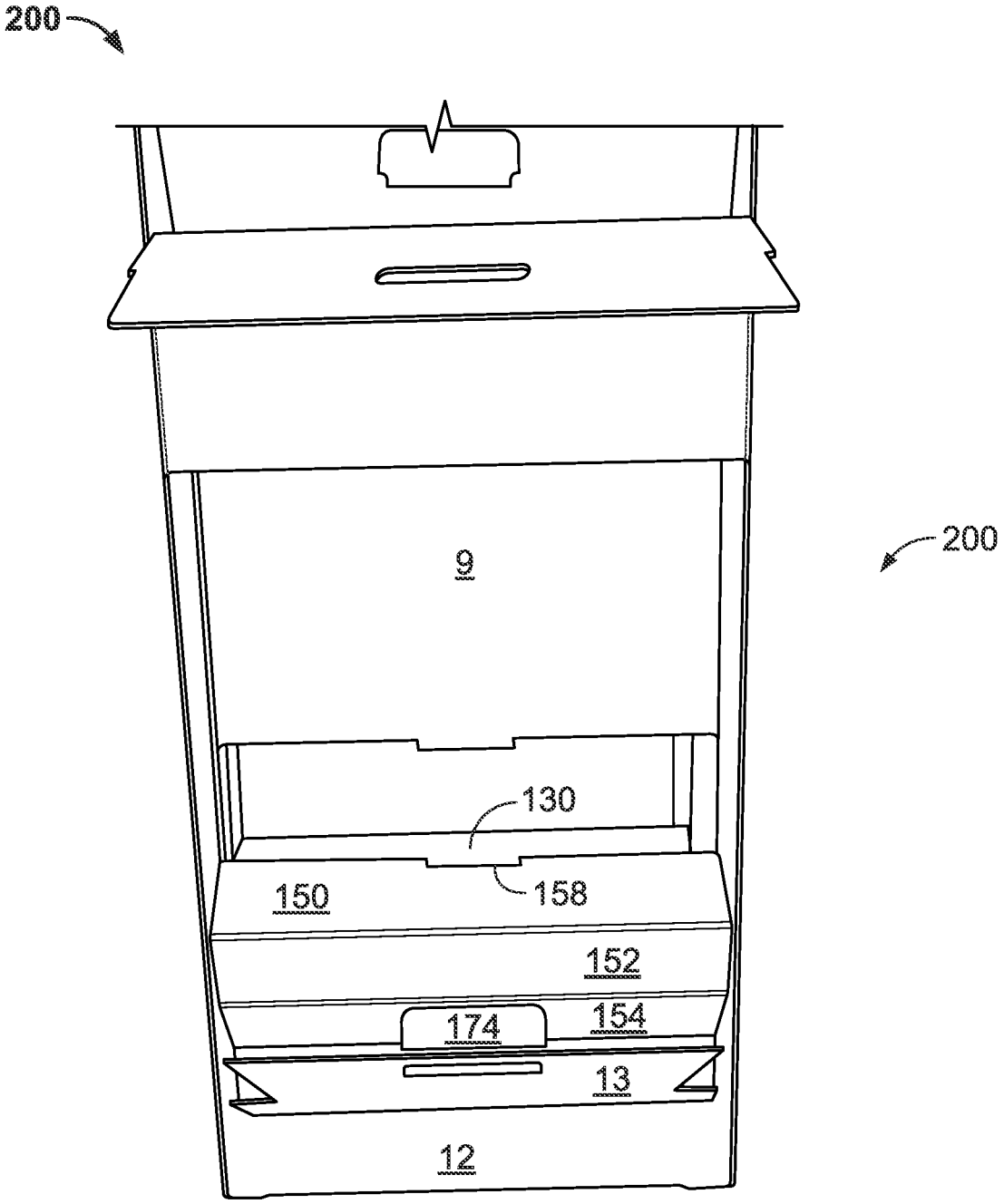
FIG. 12 is a photograph of a front view of a third shelf before folding along horizontal fold lines.

FIG. 7 shows horizontal fold lines designated with a prime (′). The panels are folded along the horizontal fold lines to complete three shelves vertically spaced from one another (FIGS. 10-12). While three shelves are shown in FIG. 8 and four shelves are shown in FIG. 15 it is contemplated having as few as two shelves and as many as needed and fits within the dimensional limitations of use. In one preferred form of the invention the hutch will have from two to six shelves.

Figure 9:
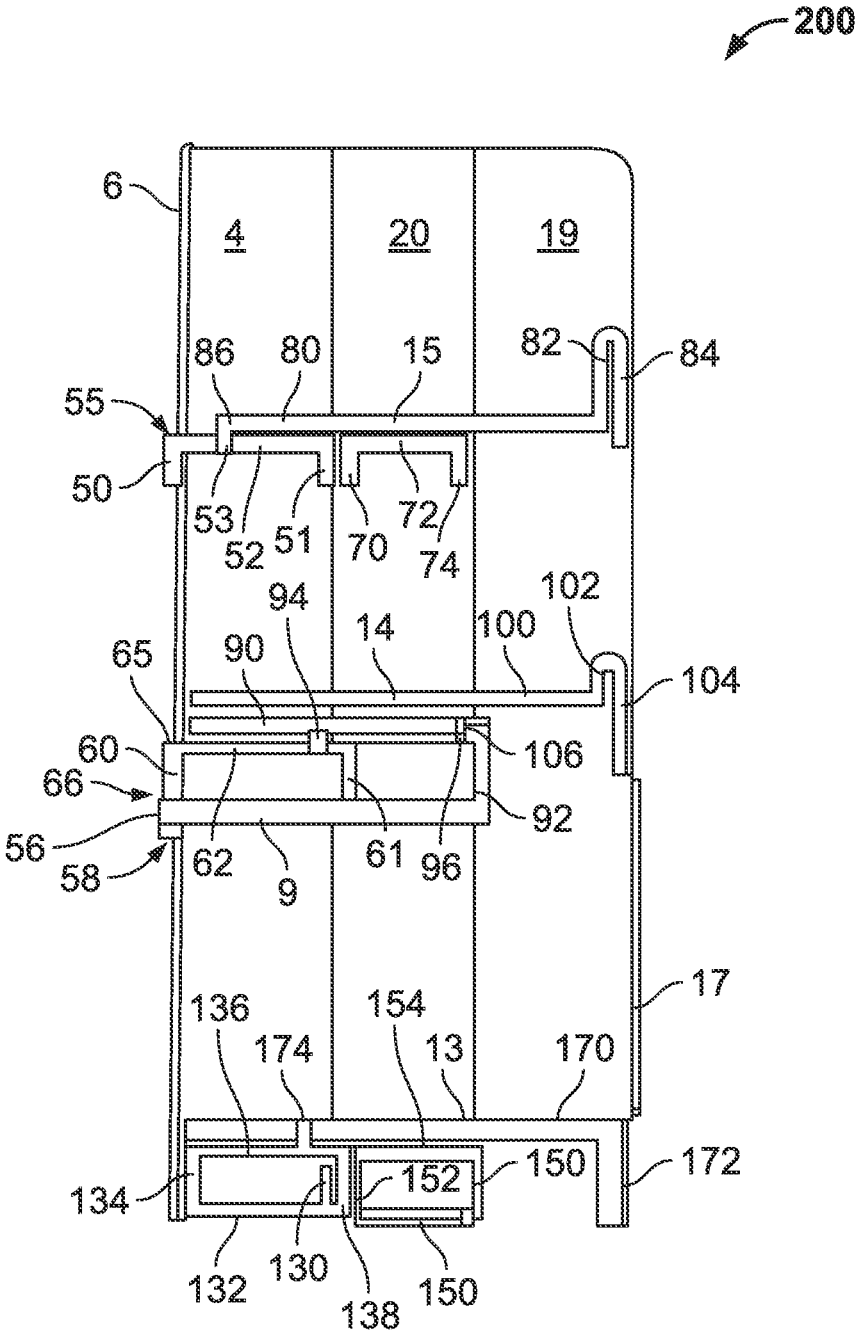
FIG. 9 is a side elevation view taken along a line through a center of the shelves from front to back.

The following folds are for completing the top shelf or first shelf. FIG. 10 shows the first shelf in an unfolded state and FIG. 9 shows all of the shelves in a folded state. Panel 1 has three horizontal fold lines and three sub-panels 50, 51, 52, and slot 53 centrally disposed on fold line 2.5'. To construct this part of the shelf, fold panel 50 90° along line 1.5' toward panel 6, and panel 52 90° along line 2.5' and insert panel 50 through slot 54 of panel 6 (See FIG. 13). Panel 53 is oriented horizontally, panel 51 is oriented vertically, and slot 53 faces upwardly. An inner surface of panel 50 is in face-to-face contact with a portion of an outer surface of panel 6 and a surface 55 of the slot 54 abuts a portion of a lower surface of panel 52 along line 1.5' and supports panel 52. In a preferred form of the invention, panel 50 points downwardly. Panel 9 has a tab 56 centrally disposed along a distal end edge and is folded along line 3.5' 90° upward toward panel 6 and inserted into tab 58 in panel 6 and extends outward from a rear surface of panel 6 (See FIGS. 9 and 13).

Panel 7 has two fold lines 6.5', 7.5' and three sub-panels 70, 72, 74. To construct this part of the shelf, fold panel 70 90° along line 6.5' and panel 72 along line 7.5' to form a U-shaped member with panels 70 and 74 being disposed vertically in parallel spaced relationship and panel 72 oriented horizontally. Panel 70 is placed into face-to-face contact with panel 51 of panel 1 (FIG. 9).

Panel 15 has two fold lines 8.5' and 9.5', three panels 80, 82, 84, and a tab 86. The tab 86 can be pressed and broken away from the panel 80 to pivot along a hinge 85. The tab 86 has a peripheral edge that can be weakened, for example by partially cutting through the panel so that three edges are frangibly connected to the panel 80 and one edge 85 forms a hinge. To construct this part of the shelf, fold panel 82 180° toward the back wall and downward along line 8.5' to place panel 82 into face-to-face contact with a rear surface of panel 84 (FIG. 9). Thus, panel 82 provides vertical support from above panel 15. Fold panel 80 90° upward and toward back wall 6 and over panels 52, 72, and deform tab 86 downward and insert it into slot 53. Slot 53 retains the tab 86 and, in a preferred form of the invention, releasably retains the tab so that it can be removed without destroying the tab 86. Panel 80 is in surface contact and is supported by panels 52, 72. Thus, as shown in FIG. 9, the first shelf has three horizontally extending supports panels 52,72,80 supported along the entire length of four horizontally extending and horizontally spaced fold lines 1.5',2.5',7.5',9.5' by vertically extending panels 6 through slot 55,4,20,82. Panels 6 through slot 55, 4 and 20 provide support from below panel 15 and panel 82 provides support from above panel 15.

Figure 13:
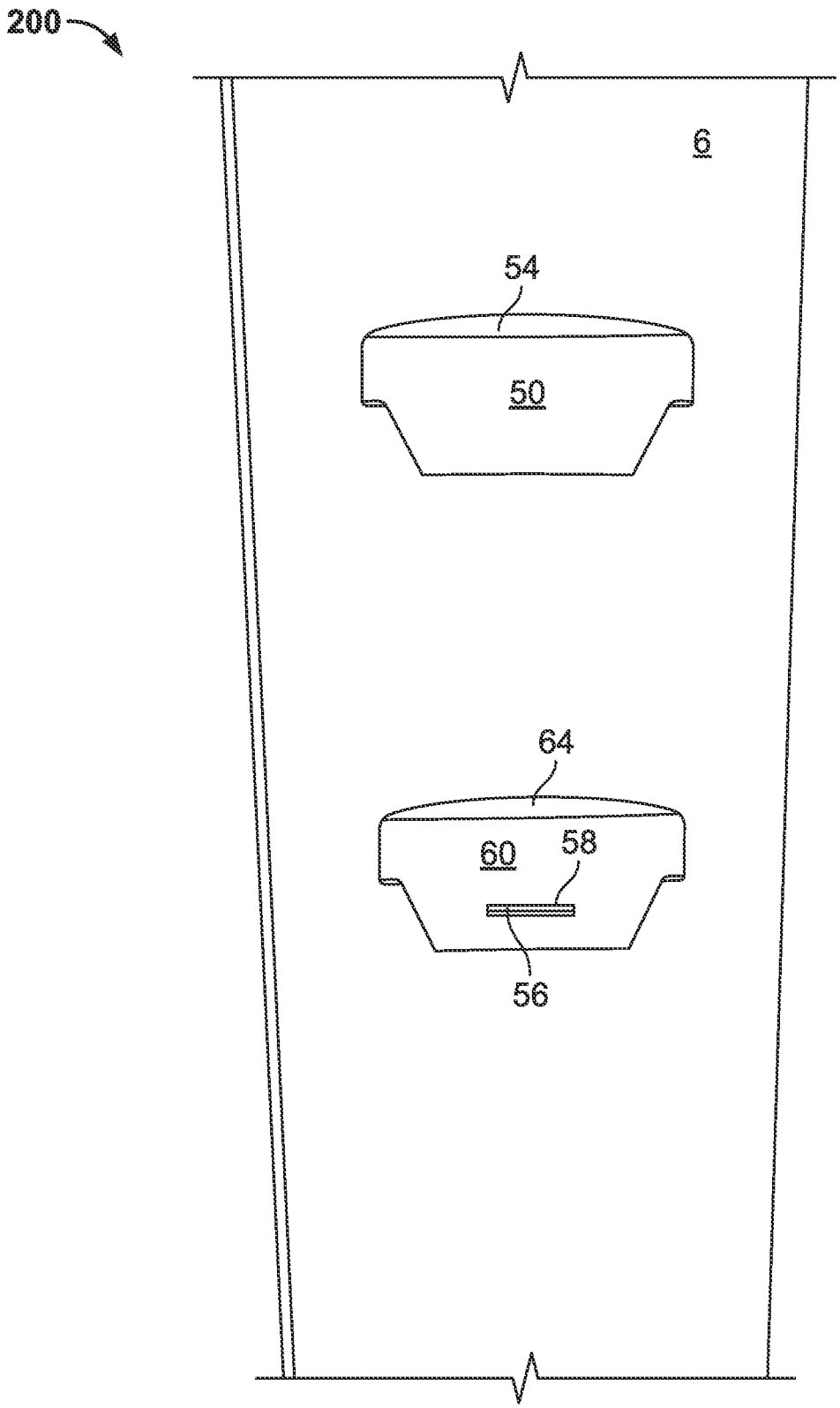
FIG. 13 is a front elevation view of a rear wall of the hutch.

The following describes the folding of the panels (FIG. 11) to complete the second shelf vertically spaced below the first shelf. FIG. 7 shows panel 2 has three panels 60, 61, 62, two horizontal fold lines 4.5' and 5.5' and two slots 63, 66. Fold panel 60 90° along line 4.5' toward the back panel 6; fold panel 62 90° along line 5.5' toward the back wall 6 and insert panel 60 into slot 64 of the back panel 6 and place slit 66 of panel 60 over tab 56 to form an interference fit therewith (FIGS. 9 and 13). An inner surface of panel 66 is in face-to-face contact with a portion of an outer surface of panel 6. A top surface 65 of the slot 64 abuts an underside surface of panel 62 along fold line 5.5' and supports panel 62 in a horizontal orientation. When so folded, panel 2 defines a generally U-shaped structure with two vertical panels 60 and 61 and one horizontal panel 62 connecting the vertical panels. The U-shaped structure 60,61,62 is positioned within a U-shaped structure formed by horizontally extending panel 9 on the bottom, horizontally extending panel 90 on the top and vertically extending panel 92 connecting panels 9,90 (FIG. 9).

Panel 8 has panels 90 and 92, separated by fold line 10.5', tab 94 centrally disposed on panel 90 and frangibly connected thereto, and slot 96 is centrally disposed along line 10.5'. Panel 90 is folded 90° downward toward the back wall and tab 94 is folded 90° downward to form an L-shaped member and inserted into slot 63 of panel 2. Slot 96 and a surface of panel 90 face upwardly and panel 92 has a planar surface oriented vertically.

Panel 14 has three panels 100, 102, 104, and a tab 106 frangibly connected and centrally disposed on panel 100. Panel 102 is folded 180° toward the back panel 6 along line 11.5' and positioned in face-to-face contact with an inner surface of panel 104. Panel 100 is folded 90° upward along fold line 12.5'. Tab 106 is pressed downward from panel 100 and remains connected along a hinge 108 and the remainder of the tab is inserted into slot 96. This completes a second shelf with a horizontal surface with panels 14, 8, 2 supported along a length dimension by supports 102 and 104 providing support from above the second shelf and panels 92, 61 and 60 from below panel 8 and 14.

The following describes the folding of the panels to complete the third shelf (FIG. 12) or bottom shelf vertically spaced below the second shelf. FIG. 7 shows panel 3 has five panels 130, 132, 134, 136, 138; cutout 140; and a slot 142. In a preliminary fold, panel 3 is folded along lines 13.5' to 15.5' to place panel 130 into contact with an inner surface of panel 136 to form a first rectangular prism with panel 134 forming a horizontally extending surface and panels 136 and 138 oriented with a vertically extending and coplanar surface. This preliminary fold is not shown in the figures. The rectangular prism is then rotated about fold line 16.5' 90° so that panel 132 forms a bottom wall extending horizontally, panel 136 forms a top wall extending horizontally, panel 134 extends vertically and abuts an inner surface of the back panel 6, panel 130 is positioned inside the rectangular prism extending roughly vertically and abuts against an inner surface of panel 138 which has a vertically extending planar surface as is shown in FIG. 9. Cutout 140 is provided for ease of folding.

As shown in FIG. 7, panel 10 has four panels 150, 152, 154, 156; and a cutout 158. Panel 10 is folded along lines 17.5' to 19.5' to form a second rectangular prism with panel 154 forming a horizontally extending planar surface and panels 152 and 156 having a vertically extending planar surface. Cutout 158 is provided for ease of folding.

As shown in FIG. 7, panel 13 has two panels 170, 172, and tab 174 frangibly connected to and centrally disposed on panel 170 and connected by a hinge 176. Panel 13 is folded 90° toward the back panel along line 20.5' and tab 174 is pushed downwardly and inserted into slot 142. This completes the bottom shelf. Thus, the bottom shelf has five horizontally extending supports 170, 132, 136, 150, 154 and seven vertical supports 130, 132, 134, 138, 152, 156, 172.

Four foot panels 180 are folded 90° along line 21.5' toward an interior of the hutch to form feet.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims. The appended claims should be construed broadly and in a manner consistent with the spirit and the scope of the invention herein.

We claim:

1. A hutch comprising:

a first side wall having a front edge and a rear edge;

a second side wall having a front edge and a rear edge spaced from the first side wall;

a back panel extending between the rear edge of the first side wall and the rear edge of the second side wall;

a front panel extending between the front edge of the first side wall and the front edge of the second side wall;

a first panel extending from between the front edge and the rear edge of the first side wall to between the front edge and the rear edge of the second side wall spaced from the front panel and the back panel;

a second panel extending from between the front edge and the rear edge of the first side wall to between the front edge and the rear edge of the second side wall spaced from the front panel, the first panel and the back panel;

a first spacing panel connected to a first side of the back panel and to a first side of the first panel, the first spacing panel spaces the first panel from the back panel; and, a plurality of shelves extending from the front panel to the back panel.

2. The hutch of claim 1 further comprising a first glue panel connected to a second side of the first panel, the first glue panel glued to an inner surface of the first side wall.

3. The hutch of claim 2 further comprising a second spacing panel connected on a first side to the rear edge of the second side wall and on a second side to a first side of the second panel.

4. The hutch of claim 3 further comprising a second glue panel connected to a second side of the second, the second glue panel glued to the inner surface of the first side wall.

5. The hutch of claim 4 wherein the first spacing panel is folded 90° with respect to the back panel.

6. The hutch of claim 5 wherein the second spacing panel is folded 180° with respect to the second side wall.

7. The hutch of claim 6 further comprising a first shelf panel having a front edge connected to the front panel and being foldable to the back panel forming a horizontal support surface and creating a first opening in the front panel.

8. The hutch of claim 7 further comprising a first vertical support panel in the front panel on a first side of the first shelf panel and a second vertical support panel in the front panel on a second side of the first shelf panel, the first vertical support panel foldable to be adjacent the inner surface of the first side wall and the second vertical support panel foldable to be adjacent to an inner surface of the second side wall.

9. The hutch of claim 1 wherein the first panel includes a first plurality of shelf support structures for supporting each of the plurality of shelves.

10. The hutch of claim 9 wherein the second panel includes a second plurality of shelf support structures for supporting each of the plurality of shelves.

11. The hutch of claim 10 wherein each of the first plurality of support structures contact a portion of each of the plurality of shelves proximate a portion of each shelf adjacent the back panel.

12. The hutch of claim 11 wherein each of the first plurality of support structures has a generally rectangular cross-sectional shape.

13. The hutch of claim 11 wherein each of the second plurality of support structures contact a middle portion of each of the plurality of shelves.

14. The hutch of claim 13 wherein each of the second plurality of support structures has a generally rectangular cross-sectional shape.

15. The hutch of claim 1 wherein the hutch is formed from a single blank of material.

16. The hutch of claim 15 wherein the material is a corrugated paperboard.

* * * * *